US008794347B2

(12) United States Patent
Rodert et al.

(10) Patent No.: US 8,794,347 B2
(45) Date of Patent: Aug. 5, 2014

(54) ARRANGEMENT AND METHOD COMPRISING A FLUSHING HEAD FOR A ROCK DRILLING MACHINE, AND ROCK DRILLING MACHINE COMPRISING THE ARRANGEMENT

(75) Inventors: Jörgen Rodert, Saltsjö-Boo (SE); Peter Birath, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 379 days.

(21) Appl. No.: 12/736,921

(22) PCT Filed: Jun. 2, 2009

(86) PCT No.: PCT/SE2009/000284

§ 371 (c)(1),
(2), (4) Date: Nov. 22, 2010

(87) PCT Pub. No.: WO2009/148375

PCT Pub. Date: Dec. 10, 2009

(65) Prior Publication Data

US 2011/0073373 A1 Mar. 31, 2011

(30) Foreign Application Priority Data

Jun. 3, 2008 (SE) ..... 0801311

(51) Int. Cl.
*B25D 17/00* (2006.01)

(52) U.S. Cl.
USPC ..... 173/1; 173/197; 173/171; 175/293

(58) Field of Classification Search
CPC ..... E21B 17/03; E21B 6/00; B25D 17/005; B25D 2250/365; B25D 2250/065
USPC ..... 173/80, 138, 197; 175/94, 297, 393
See application file for complete search history.

(56) References Cited

U.S. PATENT DOCUMENTS

| | | | | |
|---|---|---|---|---|
| 3,892,107 | A * | 7/1975 | Handen et al. | 464/163 |
| 3,893,521 | A * | 7/1975 | Bailey et al. | 173/80 |
| 3,981,368 | A * | 9/1976 | Lundstrom et al. | 173/104 |
| 4,387,775 | A * | 6/1983 | Adolfsson et al. | 175/135 |
| 4,974,689 | A * | 12/1990 | Issakainen | 175/211 |
| 6,481,761 | B2 * | 11/2002 | Schroeder et al. | 285/334.3 |
| 6,860,340 | B2 * | 3/2005 | Rodert | 173/104 |

FOREIGN PATENT DOCUMENTS

| | | | | |
|---|---|---|---|---|
| DE | 4317037 | A1 | 11/1994 | |
| EP | 113654 | A2 * | 7/1984 | E21C 7/08 |
| EP | 0113654 | A2 | 7/1984 | |
| EP | 1592862 | A1 | 11/2005 | |
| JP | 07-20387 | | 4/1995 | |

* cited by examiner

*Primary Examiner* — Andrew M Tecco
(74) *Attorney, Agent, or Firm* — Mark P. Stone

(57) ABSTRACT

The invention relates to an arrangement designed to be inserted in a cavity (19) in a front part (14) of a rock drilling machine with a shank adapter (16). The arrangement comprises a cartridge (1) with a flushing head (2) and a guide (3) coaxially arranged to create a longitudinal channel (5) designed as a passage for the shank adapter (16).

20 Claims, 7 Drawing Sheets

ARRANGEMENT AND METHOD COMPRISING A FLUSHING HEAD FOR A ROCK DRILLING MACHINE, AND ROCK DRILLING MACHINE COMPRISING THE ARRANGEMENT

TECHNICAL FIELD

The present invention relates to an arrangement comprising a flushing head for a rock drilling machine, as well as a rock drilling machine comprising an arrangement.

BACKGROUND ART

A percussive rock drilling machine comprises basically a cylinder in which a piston reciprocates. The blows of the piston transmit impact energy via a drill steel, the free end of which is a drill bit. The drill steel comprises a shank adapter, one or a plurality of drill rods and a drill bit, all of which comprises coupling joints. In a rock drilling machine, the whole drill steel when mounted comprises a continuous central longitudinal channel for flushing medium. The shank adapter is arranged extending in a central channel of the rock drilling machine.

The front end of the drill steel comprises a drill bit arranged to drill into the rock as it rotates. The rear end of the drill steel is connected to a drive unit via the shank adapter. The shank adapter is usually supported in the rock drilling machine by a front guide and a rear guide arranged at a distance from each other.

A drilling machine normally comprises two main parts, a front part and a rear part. In many drilling machines of today, the shank adapter is mounted such that a front guide is arranged in the front part supporting the shank adapter and a rear guide is arranged in a gear in the rear part having a driving function on the shank adapter.

When drilling holes in rock, the rock particles broken off by the blows must be continuously removed from the hole. To make rock drilling possible, these rock particles have to be transported away from the drill hole continuously. This is achieved by a flushing agent—air and/or water—passing through suitable passages in the drill bit. The cuttings—rock particles mixed with flushing medium—are generally carried away in the space between the rod and the wall of the hole.

The shank adapter is designed as a cylinder with an internal channel extending axially. In a rock drilling machine comprising a shank adapter, the flushing medium is applied into the flushing head and further via the shank adapter to the drill bit via the adapter channel and the tubular drill string.

To prevent the flushing medium from entering the drilling machine, the shank adapter is sealed against the flushing head by means of flushing seals. In this way, the flushing medium is prevented from entering the drill machine, which prevents damage to the drill machine.

In mine environments with damp air and occasionally saline flush water, the flushing water causes problem. The surface of the shank adapter quickly becomes corroded and the surface upon which the flushing seals must glide becomes highly wearing. The relatively short lifetime of the flushing seals is one important reason why rock drilling machines need to be serviced.

The document DE 4317037 A1 teaches a rock drilling machine comprising a flushing head, which is arranged in front of the drilling machine. In this design, the flush sealing is relatively unprotected against drill cuttings and its lifetime is shortened. Further, the shank adapter front guide is placed relatively close to the corresponding rear guide. This renders the guiding of the shank adapter less stable.

In prior art rock drilling machines, there is an alternative solution where the flushing head is arranged inside the front part of the drilling machine. When this kind of rock drilling machine needs to be serviced, the whole front part together with the shank adapter is demounted. Then, the shank adapter, the flushing head with flushing seals and a stop ring have to be detached from the front part and the flushing seals in the flushing head are exchanged.

After service, the parts have to be mounted again. Then, usually, there is a pin to be inserted in the flushing head to keep it in place and avoid rotational movements as well as providing a channel for delivering flushing water. Due to this pin, there is only one correct position for the flushing head and this position is hard to find.

This part of service is very heavy work and it takes a lot of effort and time to demount and mount the machine parts mentioned.

Thus, there are needs to reduce the service costs. These needs cannot be fulfilled by the rock drilling machines according to the above-mentioned prior art.

SUMMARY OF THE INVENTION

An object of the invention is to facilitate servicing a percussion rock drilling device comprising a housing and a hammer piston movable to-and-fro in the housing, where the hammer piston is intended for exerting the drilling tool/drill steel to impacts. The problem to be solved is to eliminate the need to demount the shank adapter when exchanging flushing seals.

According to an aspect of the present invention, there is provided an arrangement designed to be inserted in a cavity in a front part of a rock drilling device comprising a shank adapter. The arrangement is designed as a cartridge comprising a flushing head and a guide coaxially arranged to create a longitudinal channel designed as a passage for the shank adapter.

This solution according to the invention provides the front part of the drilling machine and the shank adapter stationary during service work. Thus, the need to demount the front part and the shank adapter is eliminated.

Further, the cartridge is easily accessible and easily demounted due to its position in a cavity in the front part of the drilling machine. The weight of the cartridge is relatively low and it is easy to handle during the exchange of flushing seals.

Consequently, the service work becomes less complicated and less time consuming, which in turn reduces the service costs.

The features “front” and “rear” are positions defined in relation to a drilling machine. The drilling tool is arranged in front of a drilling machine. A part arranged closer to the drilling tool is in front of a part arranged less close to the drilling tool i.e. a front part is arranged closer to the drill tool than a rear part.

The feature denoted “guide” is a feature which is arranged in direct or indirect contact with the rotatable shank adapter, when the cartridge is mounted in the cavity of a drilling machine, and is supporting and/or guiding the front end of a shank adapter.

The guide comprises e.g. a sleeve, a bushing or a bearing. The guide is made of steel, bronze, polyetentereftalat (PET) or any other suitable material. In one alternative, the guide comprises a layer of PET on the surface close to the shank adapter. The guide is made of steel, bronze, PET or any other suitable material. The flushing head is also made of steel, bronze, PET or any other suitable material. The positioning means is made of e.g. steel.

The material PET is a thermal polymeric polyester i.e. a partly crystalline thermal polymeric material, which is very stiff and can stand wear, chemicals and high temperature (up to about 220° C.) in a desirable way.

Flushing medium e.g. a fluid like water, a gas like air, foam or a mixture of these, is led to the bottom of the hole during drilling, as described above.

According to a feature of the invention, the cartridge comprises a circular means for positioning the cartridge in relation to a drilling machine, i.e. front part and shank adapter. The solution renders the orientation of the flushing head unessential and the need of a pin is eliminated. This solution decreases the service time.

According to a feature of the invention, the positioning means comprises a casing adapted to centre the guide and the flushing head coaxially within the cartridge. The casing is adapted to provide a desired high mounting accuracy after service.

Flushing seals are arranged inside the flushing head to axially seal between the flushing head and the shank adapter such that the flushing medium is not entering into the drilling machine during drilling. The flushing seals wear and the degree of wear is related to many things e.g. the mounting accuracy and decreases with high mounting accuracy.

According to a feature of the invention, the casing comprises fastening means for securing the cartridge in a drilling machine for the same reason as mentioned above.

According to a feature of the invention, the fastening means comprises an external thread.

According to a feature of the invention, the casing comprises protecting means adapted to protect the guide from dirt.

According to a feature of the invention, the cartridge comprises means adapted to protect a front part, which is exposed to heavy loads during drilling.

According to a feature of the invention, the protecting means is a lid.

According to a feature of the invention, a cartridge comprises detachable connecting means adapted to connect the flushing head and the casing. The connecting means can be bolted joints or a bayonet joint.

With the flushing head connected to the casing, the guide is locked in, as is explained below. Then, the cartridge can be handled in one piece. Cartridges comprising fresh flushing seals can be stored and used as a spare part instead of only exchanging seals during service.

According to a feature of the invention, the flushing head is designed frusto-conical. This improves the mounting of a cartridge in a cavity of a drilling machine, since it makes the main part of mounting a cartridge into a cavity less difficult. The cartridge can be pushed into the cavity without large force needed until the position means reaches the cavity entrance opening.

According to a feature of the invention, a flushing head and a guide are made in one single piece.

Another alternative is a flushing head and a guide made in two pieces made of two different materials. Another alternative is a flushing head and a guide made in two pieces made of the same material.

According to a feature of the invention, the flushing head, the guide and the casing are made in one single piece. Then, a lid is useful to protect the guide and the casing.

According to a feature of the invention a front part of a rock drilling machine comprising a cavity is designed to receive an arrangement with a cartridge.

According to a feature of the invention, a rock drilling device comprises a front part with a cavity and an arrangement with a cartridge received and detachably secured in the cavity such that the flushing head and the guide are arranged completely within the drilling machine. In one alternative, the rock drilling device is a percussion rock drilling machine comprising a housing and a hammer piston movable to-and-fro in the housing, where the hammer piston is intended for exerting the drilling tool/drill steel to impacts.

According to a second aspect of the invention there is provided a method of exchanging flush sealing means in a rock drilling machine comprising a front part designed with a cavity and further comprising a cartridge coaxially received into and detachably secured in the cavity.

The method comprises loosening the cartridge in the cavity through unscrewing at least one screwed joint, pulling the cartridge out of the cavity through sliding the flush sealing means along the shank adapter in the direction of drilling, dismount the cartridge, exchanging at least one flushing seal means arranged in an internal recess of the flushing head, mounting the cartridge, pushing the cartridge into the cavity during sliding the at least one new flushing seal means along the shank adapter in a direction opposite drilling, rotating the positioning means to move the cartridge further into the cavity during tightening the screwed joint into its final/operation position.

The sealing means of the flushing head are exchanged and/or its condition can be checked without the need of demounting the front part of the drilling machine. Further, the solution according to the invention has the advantage that the service work can be done without demounting the shank adapter.

Consequently, the solution according to the invention makes service work less demanding.

The solution according to the invention comprises an alternative with a tubular non-conical cartridge. In one alternative, the cartridge is designed cylindrical.

The solution according to the invention comprises alternative cartridges and/or flushing heads having non-circular cross sections i.e. the cross sections comprise three or more edges.

Further, other parts of the arrangement such as the flushing head and/or the guide can easily be exchanged when need be.

BRIEF DESCRIPTION OF THE DRAWING

The invention will be explained more closely by the description of different embodiments thereof and with reference to the appended drawing in which.

DESCRIPTION OF ALTERNATIVE EMBODIMENTS

Figure 1:
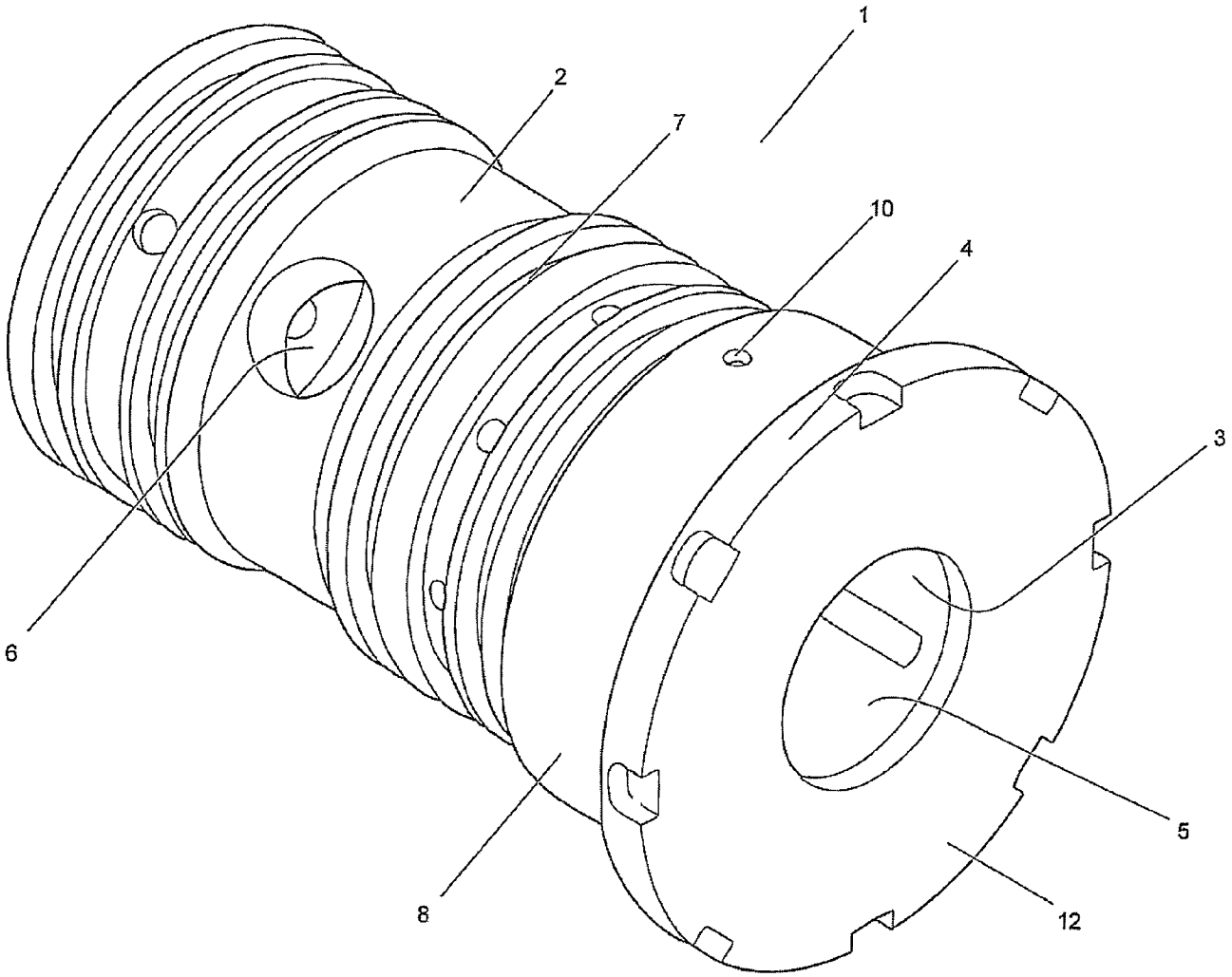
FIG. 1 is an arrangement according to the invention.

FIG. 1 is an arrangement according to the invention comprising a cartridge 1, adapted to be inserted into a cavity arranged in a front part of a rock drilling machine comprising a shank adapter. This will be described in detail below.

Figure 2:
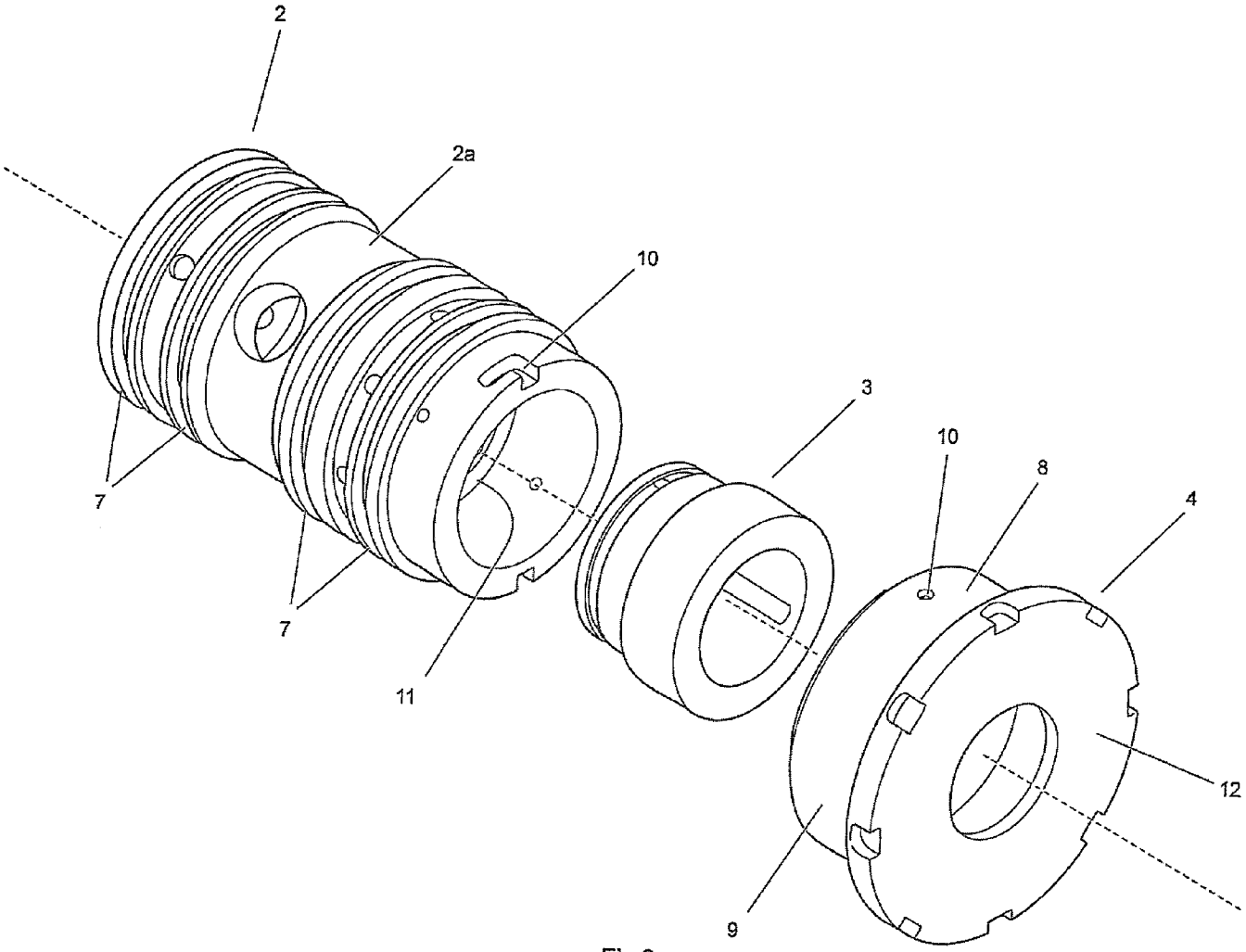
FIG. 2 is the arrangement in FIG. 1 in parts.

The cartridge 1 comprises a flushing head 2, a front guide 3, a positioning means 4 with respective longitudinal axis arranged coaxially to create a central, longitudinal channel 5 throughout the cartridge (FIG. 2).

The flushing head 2 (FIG. 3) is of a generally cylindrical design with a small inclination/cone angle and comprises a plurality of internal recesses 11 for flushing seals and external grooves 7 for O-rings. The flushing head further comprises at least one inlet opening 6 for flushing medium entering from outside.

The positioning means 4 comprises a cylindrical casing part/collar 8 with an external thread 9 and a protecting part 12 designed as a lid.

The flushing head 2 and the positioning means 4 comprise inter-connectable means 10 for locking the two parts together to create a one piece flushing cartridge. The flushing head 2 and the positioning means 4 are interconnected such that the guide 3 is fastened in between.

Figure 4:
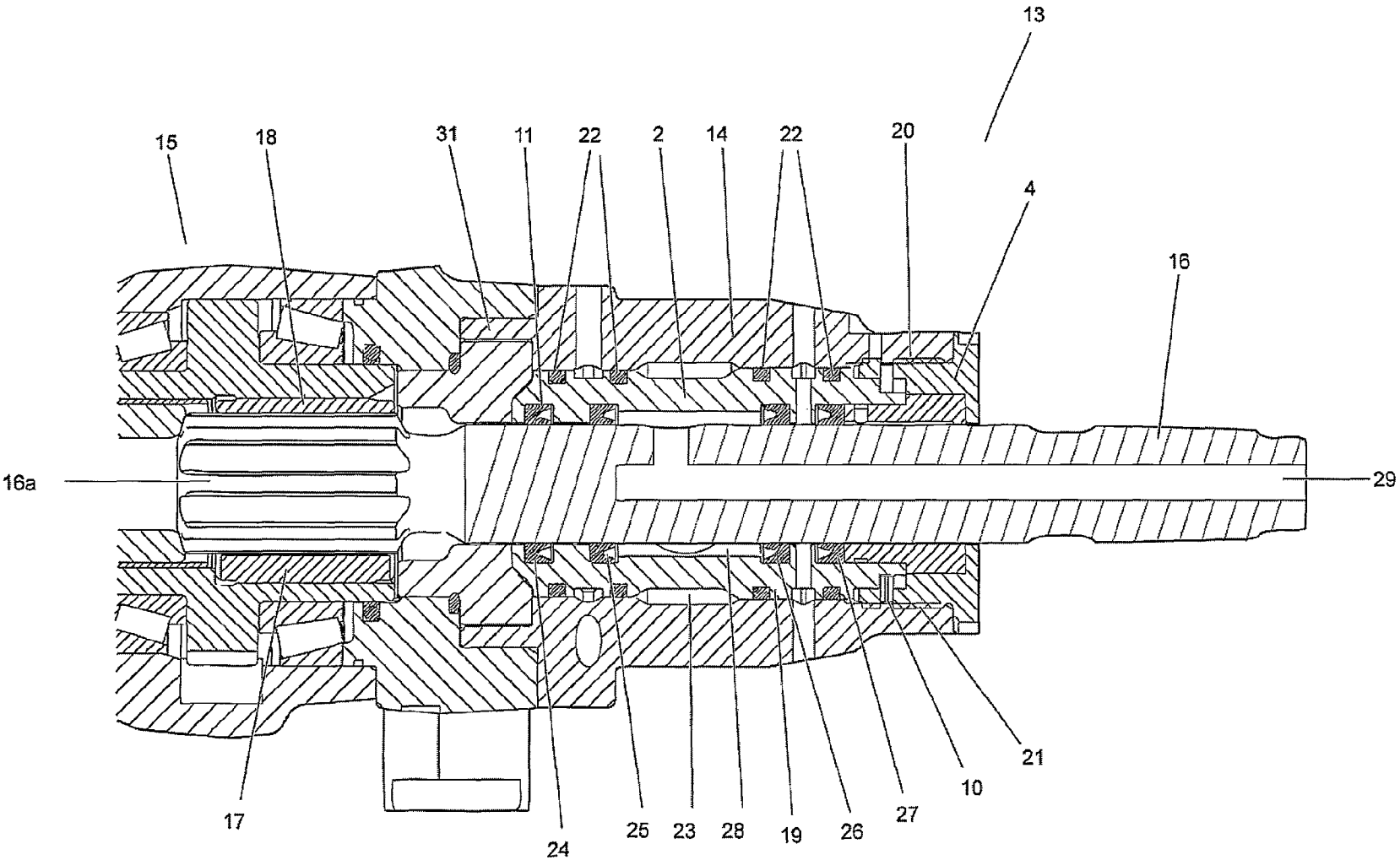
FIG. 4 is a cross section through a part of a rock drilling machine with a mounted arrangement according to the invention.

FIG. 4 is a cross section through a percussion rock drilling device 13 with a housing comprising a front part 14 and a rear part 15 (only partly shown) detachably connected to each other via a joint 32.

The front part 14 comprises a cavity 19, with a circular entrance opening 20 provided with an internal thread 21. The cavity 19 is designed cylinder-like with a relatively shorter diameter in the bottom of the cavity. The longitudinal axis of the cavity is arranged coaxially with the longitudinal axis of the drilling machine. The cavity is sized to be compatible with and to store the cartridge 1.

The cartridge 1 has a generally cylindrical design and is arranged such that the external diameter of the cartridge arranged close to the cavity opening is slightly smaller than the external diameter in the bottom of the cavity.

A shank adapter 16 is arranged coaxially movable in the drilling machine 13 and its function is to transmit impact energy and rotation from a power source to a drill bit (not shown). The shank adapter 16 is arranged to be rotated and moved forwards and backwards in the flushing head 2 during drilling.

The front part 14 of the drilling machine comprises an arrangement according to the invention with a cartridge 1 arranged detachable in the cavity 19.

The cartridge 1 is designed to comprise a longitudinal channel 5 designed as a passage for a shank adapter and the shank adapter 16 is mounted arranged through the channel 5, guided by the front guide 3 and guided in its rear end 16*a* by a rear guide 17 arranged in a gear 18 in the rear part 15 of the drilling machine.

The front guide 3 is supporting the shank adapter 16 for free rotation. The rear guide 17 is arranged to support the shank adapter 16 for a holding and driving function.

The cartridge comprises one or several O-rings 22 arranged in external grooves 7 on the external envelope surface 2*a* of the flushing head 2 (FIG. 2). In the embodiment shown, the O-rings 22 are adapted to seal a first space 23 between the flushing head 2 and the front part 14, where flushing medium is passing.

The flushing head 2 is sealed against the shank adapter 16 by means of two pair of flushing seals 24, 25 and 26, 27, where each seal is arranged in an internal recess 11. Each flushing seal is arranged in sliding contact with the envelope surface of the shank adapter 16.

The flushing head 2 surrounds a part of the envelope surface of the shank adapter and together with the seals 25, 26 provide a second space 28. The second space 28 is connected to the drillsteel via a feed channel 29 for flushing medium through the shank adapter.

Figure 5:
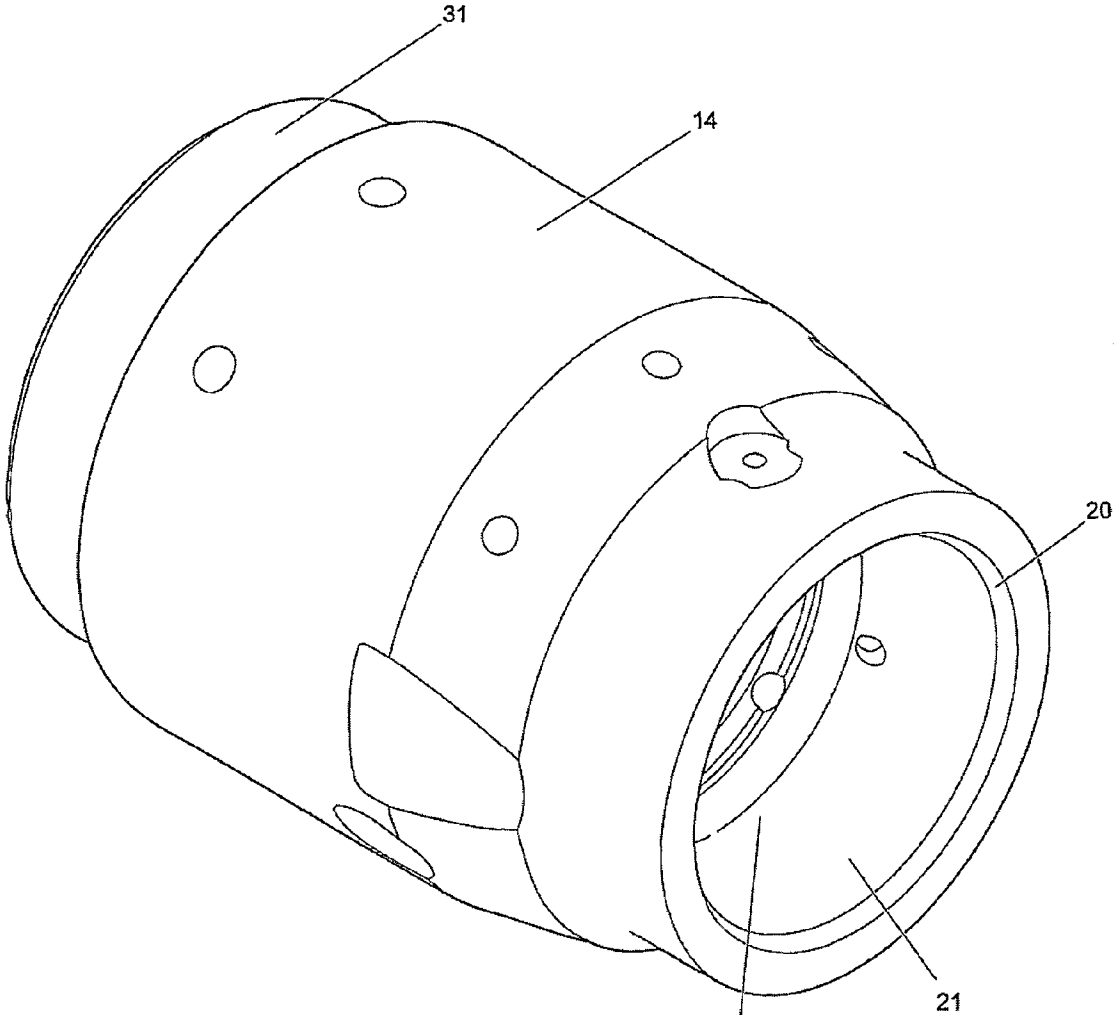
FIG. 5 is a front part of a rock drilling machine comprising a cavity.
Figure 6:
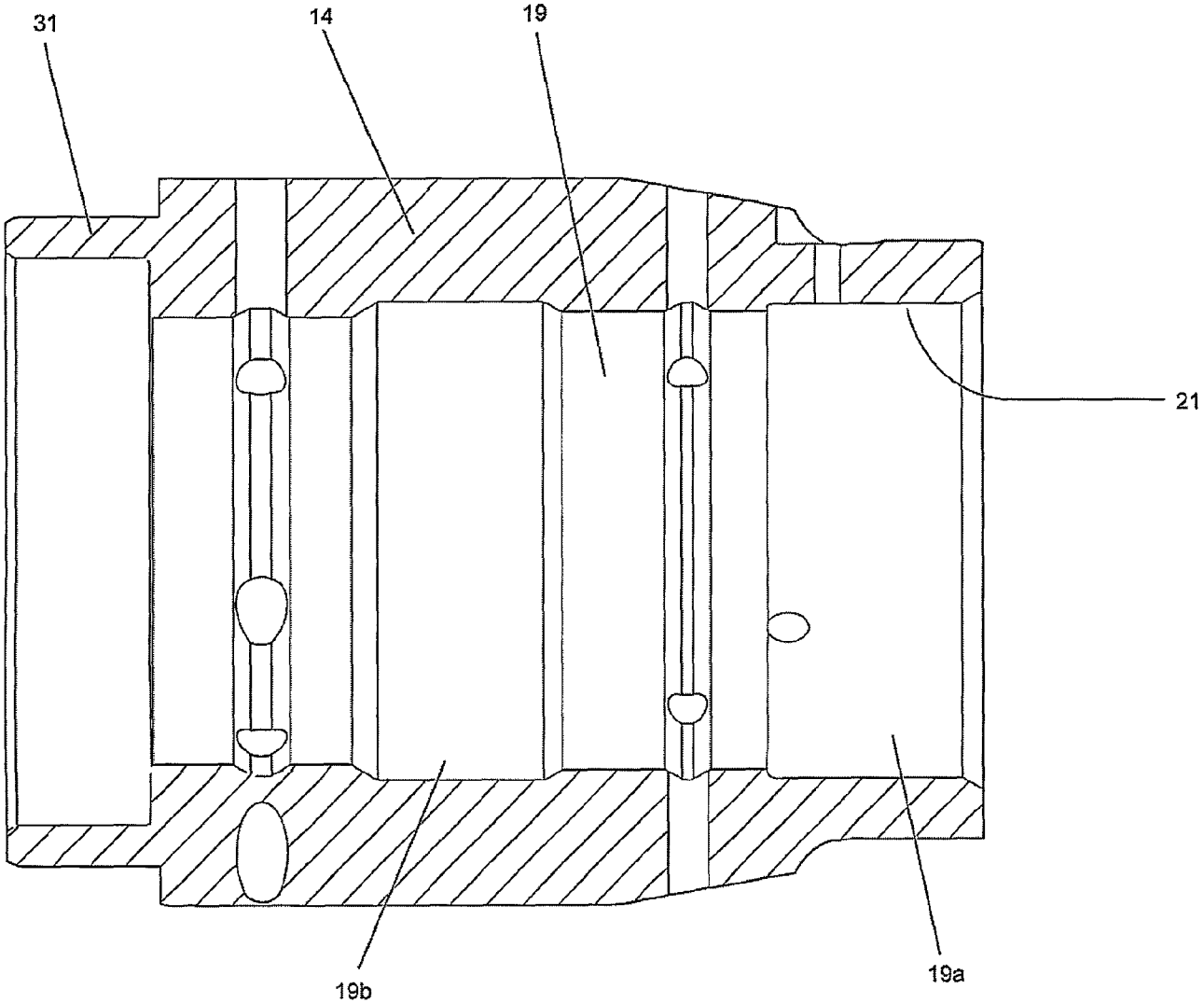
FIG. 6 is a cross section through the front part in FIG. 5.

The front part 14 of a rock drilling machine (FIG. 5) comprises a cavity 19 and a cavity entrance opening 20. The front part comprises a cylindrical cavity part 19*a* (FIG. 6) with an internal thread 21. The front part further comprises a generally cylindrical cavity part 19*b*.

Figure 3:
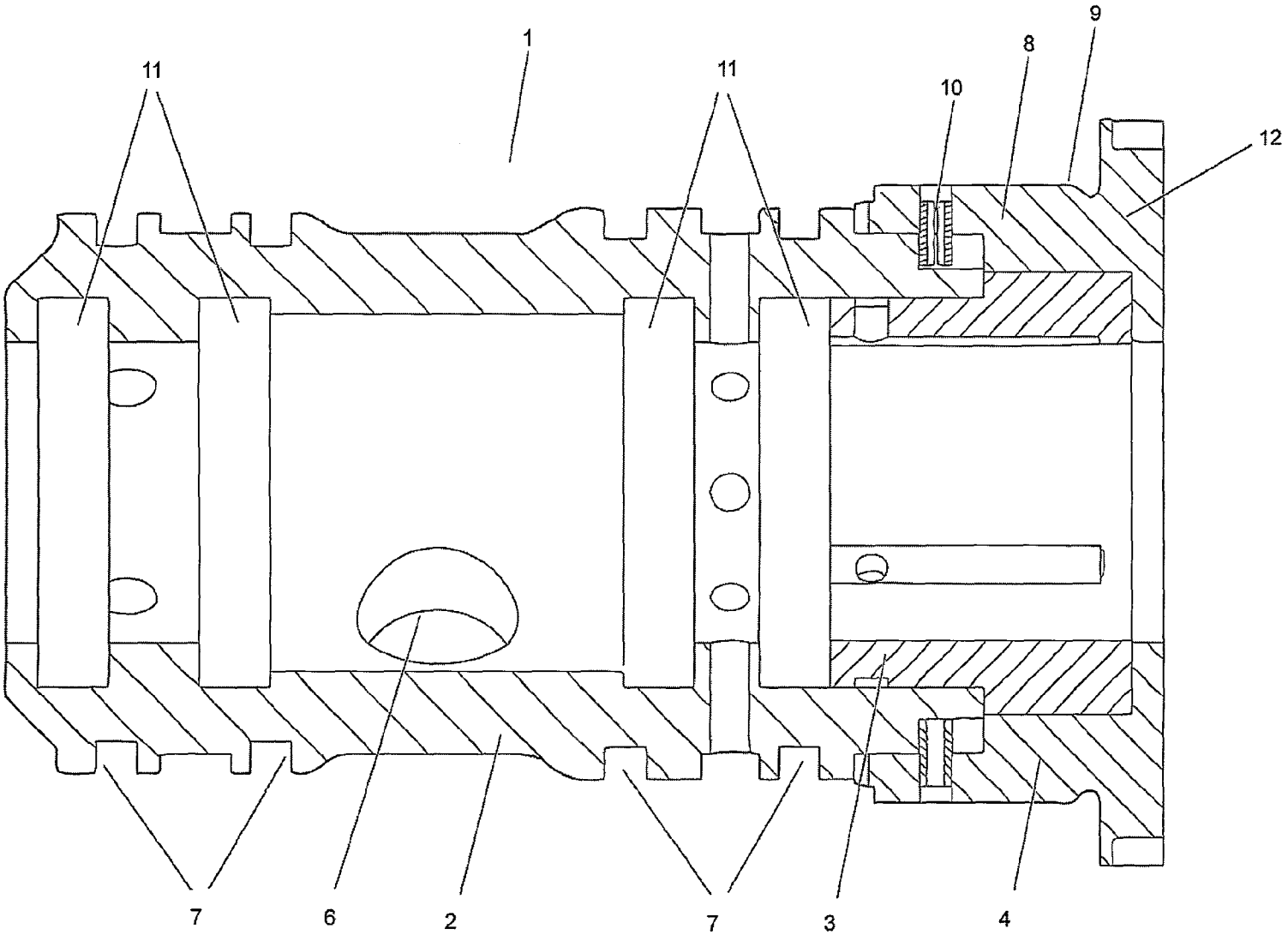
FIG. 3 is a cross section through the arrangement in FIG. 1.
Figure 7:
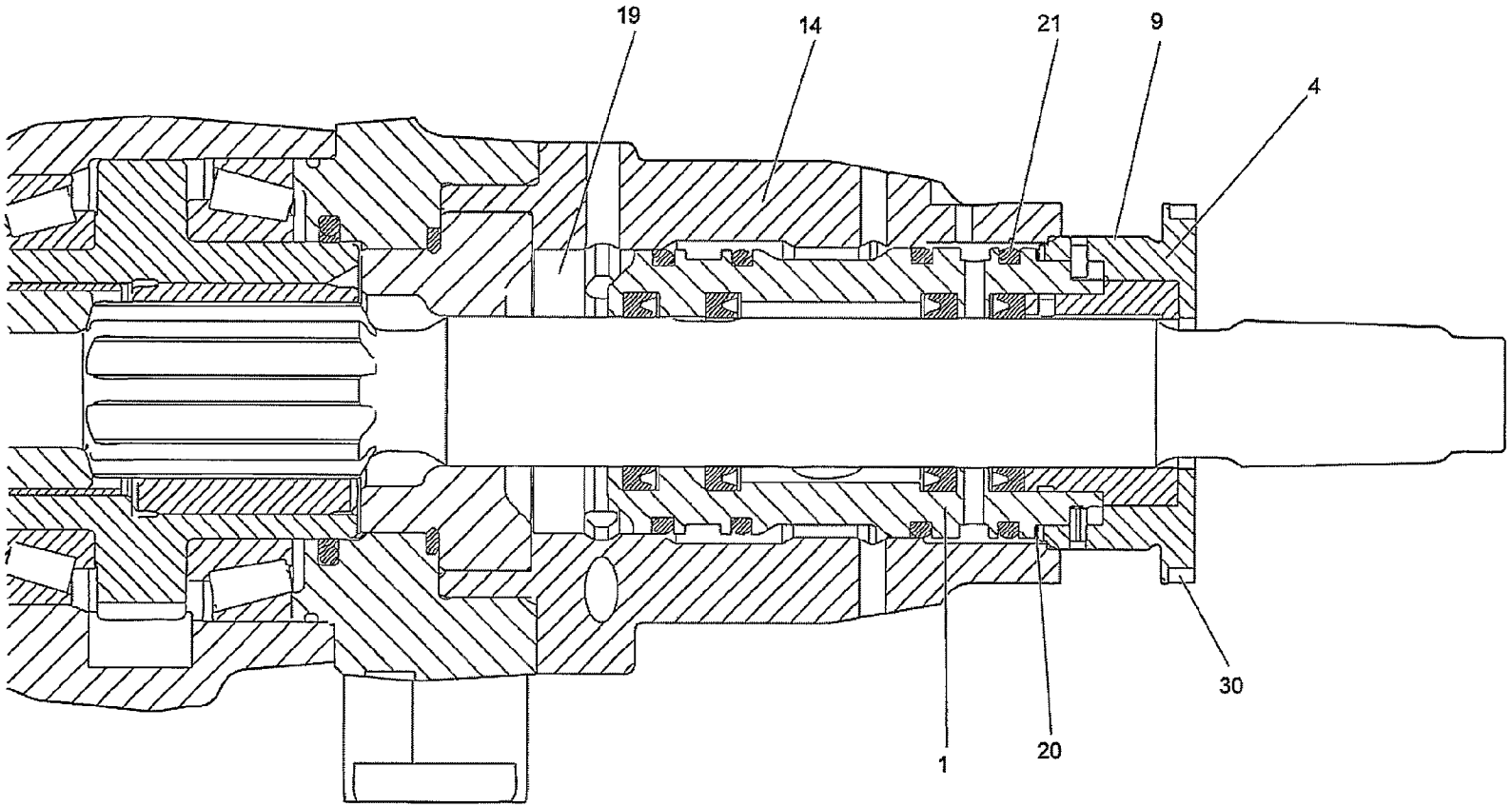
FIG. 7 is a cross section through a part of a rock drilling machine with an arrangement according to the invention in a non-final position.

When mounting a cartridge into a cavity 19 of a rock drilling machine, the cartridge is moved and slightly pushed axially into the cavity to start with. The necessary forces needed increases and at a certain position (FIG. 7) it is hard to manually press it further due to tight fit. From this position, the cartridge 1 is forced to move axially further into the cavity by rotating the positioning means 4 whereby the external thread 9 on the positioning means 4 is arranged to grip an internal thread 21 in the cavity entrance opening of the front part 14. The external thread 9 and the internal thread 30 are designed to start the gripping in this very position. Rotation of the positioning means 4 from now on causes gripping between the threads 9, 30 and an axial pushing of the cartridge 1 into the cavity 19. Due to this threaded grip and rotation of the positioning means 4, the cartridge 1 is forced to move axially into the cavity 19 and fastened in its operational position (FIG. 3). The positioning means 4 is rotated by a suitable socket tool (not shown) gripping in at least one suitable notch 30.

When mounted in a drilling machine, the guide 3 is arranged in front of all of the flushing seals i.e. closer to the drill bit than the flushing seals.

During service of a rock drilling machine, flushing seals are exchanged as explained above. The present invention provides a method of exchanging the flushing seals in a rock drilling machine where the front part comprises a cavity 19 and a cartridge 1 detachably secured in the cavity.

The method comprises:

- loosening the cartridge 1 in the cavity 19 through unscrewing at least one thread joint 9, 30,
- pulling the cartridge 1 out of the cavity 19 during sliding the flushing seals 24, 25, 26, 27, arranged in internal recesses of the flushing head, along the shank adapter 16 in the direction of drilling,
- dismount the cartridge,
- exchanging at least one flushing seal in the flushing head,
- mounting the cartridge,
- pushing the cartridge 1 into the cavity 12 during sliding the flush sealing means along the shank adapter 16 in the direction opposite drilling, and
- rotating the positioning means 4 to move the cartridge further into the cavity during tightening the thread joint 9, 30 to its final/operation position.

The invention claimed is:

1. An arrangement insertable into a cavity in a front part of a rock drilling machine having a shank adapter, wherein the arrangement is designed as a cartridge comprising a flushing head and a guide coaxially arranged to define a longitudinal channel for providing a passageway for the shank adapter inside a housing of the rock drilling machine; the flushing head being arranged completely inside of the housing of the rock drilling machine when the cartridge is in an operational position received within the housing; said flushing head carrying at least one flushing seal; said flushing head and said guide assembled together to form a unit and being removable from said housing as said unit for providing access to said at least one flushing seal.

2. An arrangement according to claim 1, wherein the cartridge comprises a circular positioning means adapted to position the cartridge in relation to a drilling machine.

3. An arrangement according to claim 2, wherein the circular positioning means comprises a casing adapted to center the guide and the flushing head coaxially within the cartridge.

4. An arrangement according to claim 3, wherein the casing comprises fastening means adapted to secure the cartridge in a drilling machine.

5. An arrangement according to claim 4, wherein the fastening means comprises an external thread.

6. An arrangement according to claim 4, wherein the flushing head is designed in a generally cylindrical configuration.

7. An arrangement according to claim 3, wherein the casing comprises a protecting part adapted to protect the guide.

8. An arrangement according to claim 3, wherein the cartridge comprises detachable connecting means arranged to connect the flushing head to the casing and lock in the guide.

9. An arrangement according to claim 3, wherein the flushing head is designed in a generally cylindrical configuration.

10. An arrangement according to claim 2, wherein the cartridge comprises means adapted to protect a front part.

11. An arrangement according to claim 2, wherein the cartridge comprises detachable connecting means arranged to connect the flushing head to the casing and lock in the guide.

12. An arrangement according to claim 2, wherein the flushing head is designed in a generally cylindrical configuration.

13. An arrangement according to claim 1, wherein the cartridge comprises detachable connecting means arranged to connect the flushing head to a casing and lock in the guide.

14. An arrangement according to claim 1, wherein the flushing head is designed in a generally cylindrical configuration.

15. A front part of a rock drilling machine comprising a cavity designed to receive an arrangement according to claim 1.

16. A rock drilling device comprising a front part with a cavity designed to receive an arrangement according to claim 1, said arrangement being detachably secured in the cavity when said cartridge is in said operational position.

17. The rock drilling device according to claim 16, wherein the device is a percussion rock drilling machine.

18. An arrangement according to claim 1, wherein said flushing head and said guide are detachably connected to each other.

19. A method of replacing at least one flushing seal in a rock drilling device comprising a shank adapter, a front part designed with a cavity and a cartridge comprising a flushing head coaxially received in and detachably secured in the cavity and having a longitudinal channel for providing a passageway for the shank adapter, said cartridge carrying at least one flushing seal, the method comprising the steps of:

loosening the cartridge in the cavity through unscrewing at least one screwed joint, removing the cartridge from the cavity by sliding the cartridge along the shank adapter in the direction of drilling, replacing said at least one flushing seal carried by the flushing head, inserting the cartridge into the cavity by sliding the cartridge along the shank adapter in a direction opposite to the direction of drilling such that the flushing head is completely inside a housing of said rock drilling device when said cartridge is in an operational position, and rotating the cartridge further into the cavity during tightening of the screwed joint into said operational position within the rock drilling device, wherein said at least one flushing seal is replaced without removing said shank adapter from said rock drilling device.

20. An arrangement insertable into a cavity in a front part of a rock drilling machine having a shank adapter, wherein the arrangement is designed as a cartridge comprising a flushing head having a longitudinal channel providing a passageway for the shank adapter, said flushing head carrying at least one seal, said cartridge being removably mounted within said rock drilling machine such that said at least one seal carried by said flushing head is replaceable by removing only said cartridge from said drilling machine without removing said shank adapter from said drilling machine, said cartridge being arranged around said shank adapter so as to be slidable along said shank adapter for removing said cartridge from said drilling machine, said flushing head being completely inside a housing of said rock drilling machine when said flushing head is in an operational position.

* * * * *